US005185890A

United States Patent [19]

Dismore et al.

[11] Patent Number: 5,185,890

[45] Date of Patent: Feb. 16, 1993

[54] TOILET BOWL SEALING ASSEMBLY

[76] Inventors: Gregory W. Dismore, 147 Pine St.; Brian R. Rollins, 33 Spring Pl., both of Portland, Me. 04101

[21] Appl. No.: 763,579

[22] Filed: Sep. 23, 1991

[51] Int. Cl.[5] ..... E03D 11/16

[52] U.S. Cl. ..... 4/252.5; 4/252.1; 4/252.6

[58] Field of Search ..... 4/252.1, 252.4, 252.5, 4/252.6

[56] References Cited

U.S. PATENT DOCUMENTS

| | | | |
|---|---|---|---|
| 2,750,216 | 6/1956 | Thies | 4/252 R |
| 3,037,212 | 6/1962 | Kleinhof | 4/252 R |
| 3,349,412 | 10/1967 | Schwartz et al. | 4/252 R |
| 3,400,411 | 9/1968 | Harvey | 4/252 R |
| 3,568,222 | 3/1971 | Gantzert | 4/252 R |
| 3,821,820 | 7/1974 | Thompson | 4/252 R |
| 4,384,910 | 5/1983 | Prodyma | 4/252 R |
| 4,406,480 | 9/1983 | Izzi | 4/252 R |
| 4,423,526 | 1/1984 | Izzi, Sr. | 4/252.5 |
| 5,018,224 | 5/1991 | Hodges | 4/252 R |

*Primary Examiner*—Henry J. Recla
*Assistant Examiner*—Robert M. Fetsuga
*Attorney, Agent, or Firm*—Laforest S. Saulsbury

[57] ABSTRACT

This invention relates to a toilet bowl sealing device or assembly for use with floor closet flanges when capped upon the sewer drain pipe to which the toilet bowl is attached so that gas and water leakage is prevented. A plastic sealing ring is used that has both external and internal tapered sealing seats, the internal seat for a corresponding tapered seat in the depending sleeve portion of the closet flange and the internal tapered seat for receiving a corresponding external tapered seat on a centering funnel adapted to be rigidly adhered to the bottom surface of the toilet bowl about its discharge outlet and used in re-assembling the toilet bowl upon the floor closet flange after inspection or replacement of a sealing ring.

1 Claim, 2 Drawing Sheets

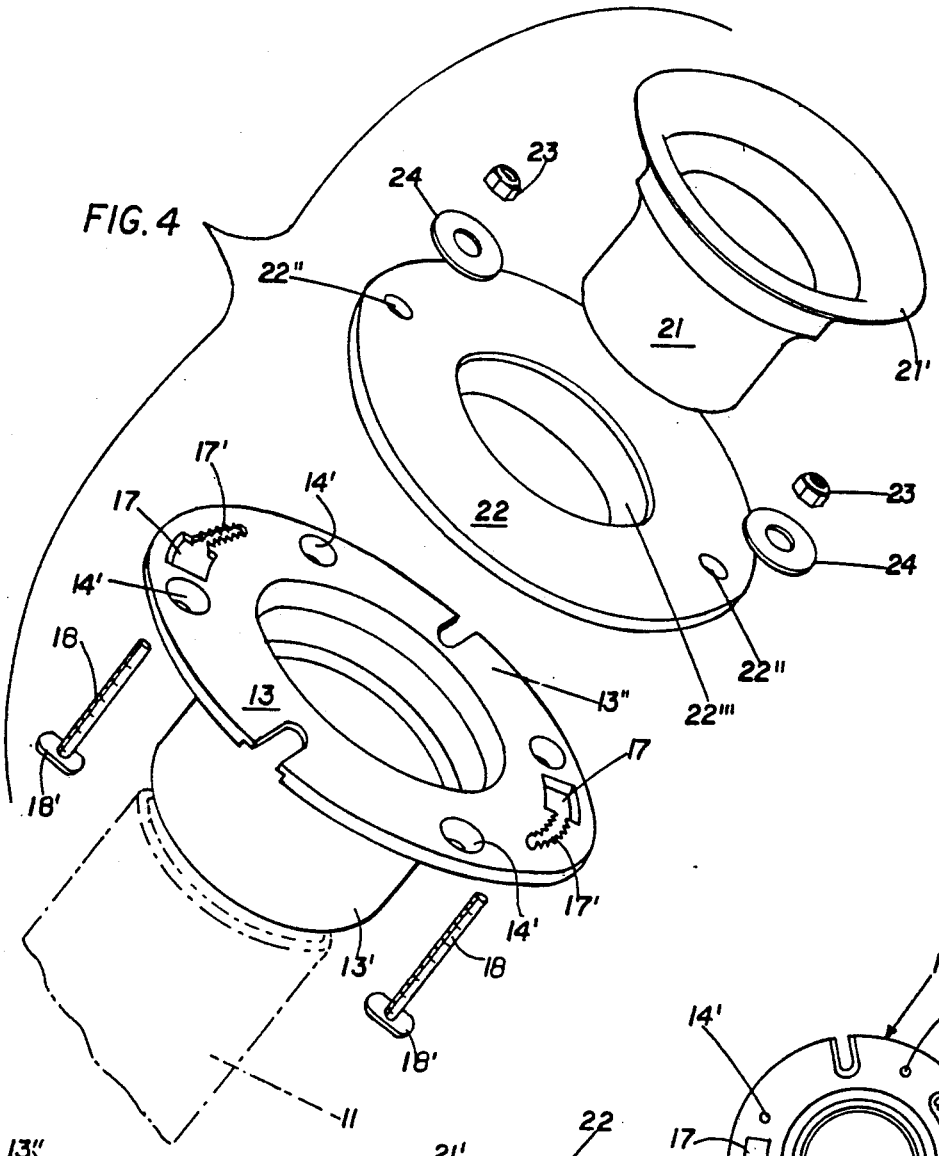
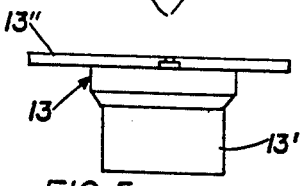
FIG. 5
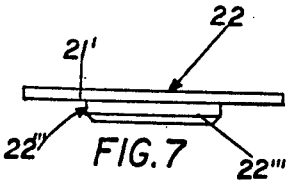
FIG. 7
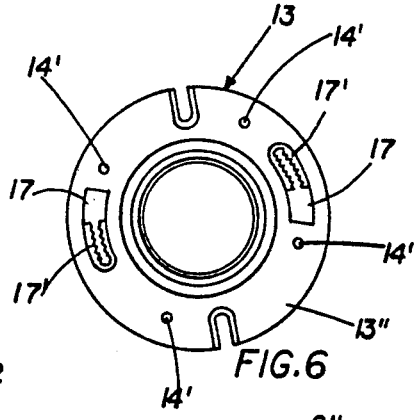
FIG. 6
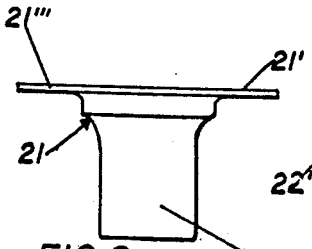
FIG. 9
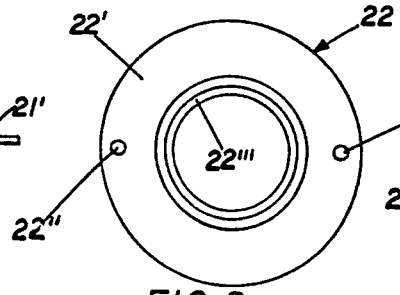
FIG. 8
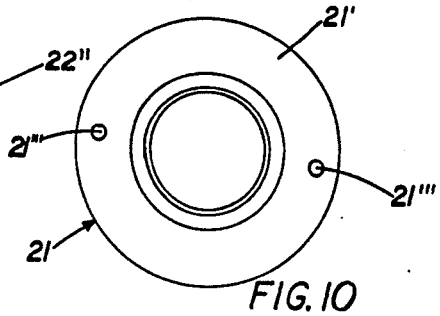
FIG. 10

TOILET BOWL SEALING ASSEMBLY

This invention relates to toilet bowl seating devices.

Many difficulties have been encountered in the sealing of toilet bowls to the closet on floor flange which anchors the sewer drain pipe to the floor and accepts the toilet sealing device seal. There can be a leakage of water and sewer gas to bathrooms if the seal engagement has not been properly made upon the drain pipe to the closet flange. On inspection, it is often found that the long used wax seal material that is disposed between the toilet bowl bottom outlet and the closet or floor flange upon the end of the drain pipe has been compacted when the toilet was not lowered evenly. The floor flange is connected to the floor and the toilet bowl is in turn bolt-connected to the closet floor flange to overlie its flange and wax seal with the underface of the toilet bowl. When installing the toilet to the sealing device, damage can be readily made upon a seal and even upon the replaced seal. Axially aligning the toilet discharge hole and avoiding off engagement and damage to the wax material is difficult. The wax material, too, can be deformed upon removal of the toilet bowl for its inspection and reassembly to the floor flange.

A common problem in renovation is that the bathroom floor has been built up and the wax seal lacks adequate thickness to make a secure connection between the bottom face of the toilet bowl and the closet flange.

It is difficult to determine whether the seal has been deformed and that it has been properly installed so that the connection is water and air tight. The wax thickness of a standard seal may not be thick enough to properly make the sealing connection between the bottom face of the toilet bowl and the collar flange of the installed floor plate. It is often necessary to have to discard the replacement seal if damaged on installation and begin again with the inspection and installation of still another seal. The removing, discarding of a failed seal and cleaning the area is a messy and difficult job. When the seal gets contaminated and dirty, it will not bend and adapt itself to become an effective seal.

This mounting of toilet bowls to closet flanges attached to open end of sewer drain pipes and the inspection for replacement has requires special skills for a suitable performance and for leakproof sealing to be perfected. Sewer gas leakage is prohibited in buildings. The sealing must be axially aligned with the open top end of the already installed closet flange. A completed installed seal must be absolutely perfect so that adequate sanitary conditions are maintained above the floor level. Wax sealing material so prevalent in the already installed fixtures over the many years is prone to damage and makes for much outlay on disassembly for inspection and replacement. Such sealing means has to be tightly coupled to the closet flange on the floor and the toilet bowl and all elements mechanically fastened together with leak-proof sealing effected between them and to provide positive sealing for water and air leakage.

It is accordingly the principle object of the present invention to provide an effective sealing means which is not subject to destruction upon being worked with or replaced at installation time and when finally installed will not leak.

It is another object of the invention to provide an effective sealing means that includes a centering part that extends the down outlet of the toilet bowl that upon installation will depend into the sealing ring secured to the closet to a point below the soil pipe closet flange junction thereof assuring a leak-free connection.

It is another object of the invention to provide a gas-proof toilet seal that will not allow sewer gas or odor to enter the house toilet room from the soil or drain pipe, once the toilet bowl has been set thereover.

It is still another object of the invention to provide toilet seal means made of clean parts with which to work throughout installation and replacement and with which upon being removed can be put back in place without damage to installed parts and for effective reseal within the drainage system.

It is a further object of the invention to provide a sealing device for toilets which with the one seal will provide for a great diversity of floor thickness and still effect a leak-proof seal.

A still further object of the invention is to provide a toilet bowl and sewer drain pipe sealing device which will allow some movement of the toilet bowl for alignment with the floor plate and will remain water and air tight.

A still further object of the invention is the ability to verify the attachment between a centering funnel and the bottom face of the toilet bowl, as well as to verify the attachment between a sealing member and the closet flange and once the centering funnel and seal are properly attached, the proper alignment and making of the connection can be verified visually during the installation of the toilet bowl.

Still further objects of the invention having the above objects in mind are to provide a toilet drain pipe sealing device which is of simple construction, has minimum number of parts, inexpensive to manufacture, easy to assemble and disassemble, particularly easy to inspect during installation and efficient to use.

For a better understanding of the invention, reference may be made to the following detailed description taken in connection with the accompanying drawing, in which:

FIG. 4 is an enlarged collective and exploded view of the several parts of the present sealing device being shown in perspective.

FIG. 5 is a side elevational view of the closet flange with its long depending sleeve portion designed to be fitted over the upper open end of the drain pipe in tight fitting engagement therewith.

FIG. 6 is a bottom plan view of the closet flange and depending sleeve portion that is attached to the drain pipe.

FIG. 7 is a side elevational view of a neoprene-like seal element fashioned to be disposed between the closet flange plate and a toilet bowl bottom face and its depending sleeve formation.

FIG. 8 is a bottom plan view of the neoprene-like seal element.

FIG. 9 is a side elevational view of the toilet bowl centering funnel with its flange and long depending centering sleeve projection, that is adhered by its flange to the bottom face of the toilet bowl about its drain opening.

FIG. 10 is a bottom plan view of the toilet bowl centering funnel with its depending centering sleeve projection with its flange by which it will be adhered to the underface of the toilet bowl.

Figure 1:
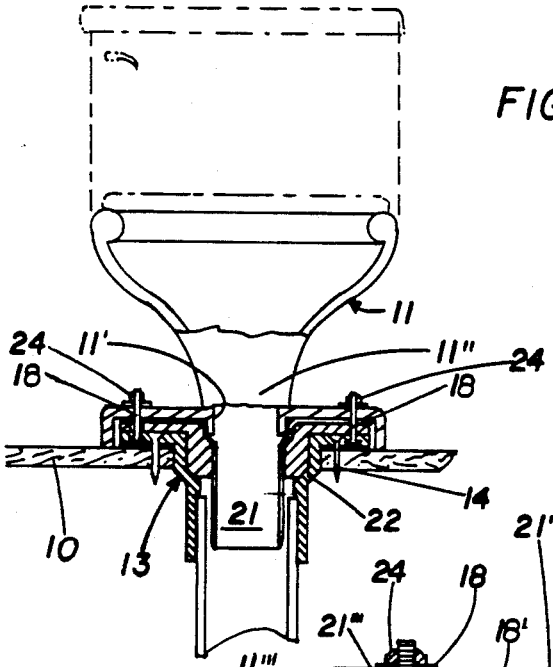
FIG. 1 is fragmentary vertical sectional view of the sealing means of the present invention, with upper portion of the water closet being shown in phantom and its bottom portion assembled to the installed floor plate with the sealing means therebetween.

Referring now to the figures, 10 represents a floor upon which a toilet bowl 11 is to be mounted. Extending upwardly to the underside floor 10 is a standard sewer drain pipe 12, generally of some 4" in diameter over which the toilet bowl 11 is to be placed for the purpose of drainage of the toilet bowl contents and water from time to time. Within the toilet bowl itself there is the usual water seal trap to prevent escape of sewer gas from the toilet bowl. In the connection of this toilet bowl onto the floor and upon the drain pipe, adequate sealing means must be provided thereabout to prevent water and gas leakage into the bathroom and upon its floor 10. On installation, there is first fitted to the open top of the drain pipe 12 and secured to the floor 10 from through its opening 10' of a diameter greater than the external diameter of the drain pipe 12, and in this opening 10', there is lowered and secured by a plastic or metal closet flange 13 having a long pending sleeve portion 13' adapted for attachment by its flange 13" to the floor by 10 by means of wood screws 14 extended through holes 14' in the flange 13". Such a closet flange 13 is disclosed in U.S. Pat. No. 3,846,851 and is of a more or less standard shape of such closet flanges that are marketed. The sleeve portion 13' of this closet flange 13 is internally shouldered at 16 to receive the open top edge of the drain pipe 12 and sealing cement will be used to adhere the closet flange 13 to the drain pipe 12 to prevent leakage of gas and fluid from escape thereabout.

Upon placing the closet flange 13 upon the floor 10 diametrically-disposed undercut holes 17 are provided in the flange 13" of closet flange 13 to accommodate heads 18' upwardly of extending bolts 18 that are used for the securement of toilet bowl 11 to the closet flange 13 and the floor 10. The closet flange 13 will have been fixed to the floor 10 by screws 14 extending through flange holes 14' in its flange 13" and installed upon the floor 10. With the closet flange 13 in place the bolts 18 are extended by their heads 18' in the open holes 17 and slid into the undercut recesses 17' for retention. The toilet bowl 11 has a central discharge sleeve portion 11' depending from its bottom smooth face.

Before the toilet bowl 11 is secured to the closet flange 13 and in keeping with the invention, there has been provided a semi-rigid plastic centering funnel 21 that is adhered by its flange 21' to the smooth underface of the toilet bowl 11 about the depending portion 14' and its discharge opening 11" in a rigid manner which makes easy the alignment and replacement of the toilet bowl 11 upon the closet flange 13. This centering funnel 21 has its flange 21' secured to the underface of the toilet bowl and is axially aligned with its discharge opening 11" with suitable adhesive so that it is rigidly, centrally and firmly secured to the toilet bowl 11. Its sleeve portion 21" is tapered and sufficiently long so as to depend well into the open top end of the drain pipe 12 and closet flange to ensure full central and axial alignment with the drain pipe 12 and the depending sleeve portion 13' of the closet flange 13.

Before installing the toilet bowl upon the closet flange 13, there will have been inserted a neoprene-like sealing ring 22 taking the internal general shape of the closet flange 13 and of the attached funnel 21 to provide a durable sealing ring of soft depressable material in order that once installation is made, an effective seal will have been provided.

This sealing ring 22 has a laterally-extending flange22' with bolt holes 22" for accommodating the upstanding bolts 18 and by which the sealing ring overlies the closet flange 13 on being seated thereinto for its depending portion 22''' to engage an internal seat **13*a* of the closet flange 13. The centering funnel 21 has an external seat 21*a* with which to engage the sealing ring 22 on being centered therethrough. In this manner, all parts are fully nested in one another to establish an effective seal device upon the toilet bowl being secured by bolts 18 to the closet flange 13 and to the floor 10**.

Figure 2:
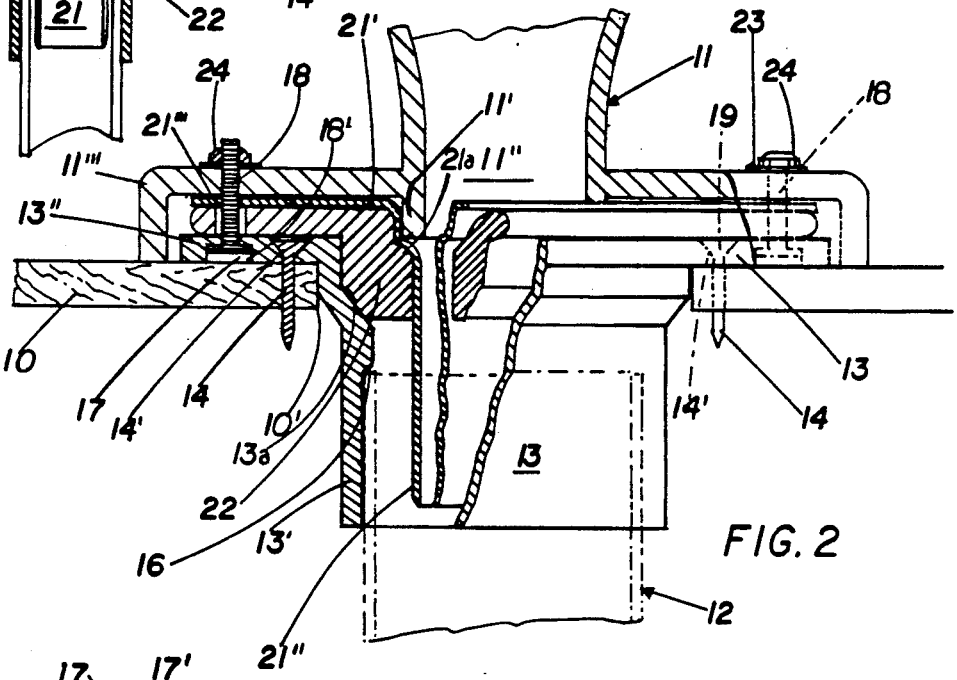
FIG. 2 is an enlarged fragmentary vertical sectional view similar to FIG. 1 as assembled to a floor and to the sewer drain pipe.
Figure 3:
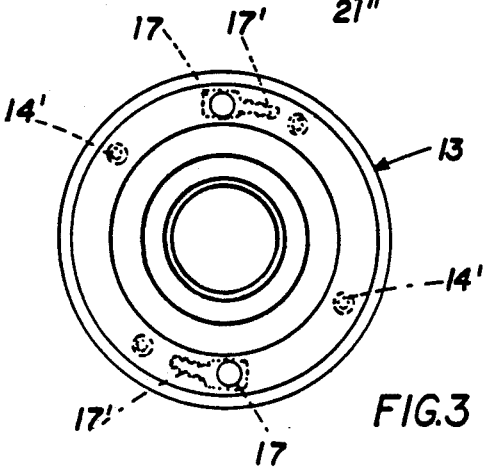
FIG. 3 is a top plan view of the flanged floor plate secured to the floor and the toilet bowl unassembled therefrom.

While the flange 21' of this semi-rigid plastic centering funnel 21 is as shown in FIG. 2, 9 and 10 made wide to include bolt holes 21''' to receive headed bolts 18 so that the centering funnel 21 will be locked in the final assembly with bolts 18 it may for ease of use in the assembling be merely cemented by its flange with not need for bolt hole therein and be adequate. Such a funnel 21 without bolt holes in its flange is shown in FIG. 4 as a slight modification. It should also be understood that the sealing ring 22 may be adhered to the closet flange 13 with a suitable adhesive and without the need for the bolt holes 22".

Once the nuts 23 and washers 24 are applied to the bolts 18 that have been extended upwardly from the closet flange through the sealing ring 22 and toilet bowl bottom and tightened upon bolts 18, a solid leak-proof connection of the entire assembly and a solid mechanical attachment to the floor 10 will have been effected.

While there has been provided the sealing member 22 of neoprene-like material, it can be understood that the centering funnel 21 would have equal application with the standard wax seal material of which care must be taken to prevent breakup of a more fragile material. With this present device, there is no chance of leakage of gas or water between the closet flange 13 and the centering funnel 21 and the toilet bowl 11 is made secure to the floor.

At times when it is desired to inspect the toilet bowl 11 and connection with the drain pipe 12, the toilet bowl 11 with the centering funnel 21 is removed and can be replaced with its adhered centering funnel 21 still attached for another sealing engagement with the drain pipe 12 either with the present sealing ring or over the standard wax seal. If the standard wax seal is found needing to be replaced the centering funnel would still be helpful for making the new installation without tendency to damage such new wax seal being replaced.

It should be apparent that the neoprene-like seal in the present combination will be much more durable and have much less need for inspection. The standard wax bowl ring gasket that is so easily destructive with handling is eliminated by use of this present seal assembly and the centering funnel most helpful for the inspection procedure for determining the need for a new sealing ring 22.

What is claimed is:

1. In a toilet bowl assembly, a toilet bowl having a base with bolt holes for securing the bowl to a floor, a sewer drain pipe, a closet floor flange fitted upon a top of the sewer drain pipe and adhered thereto and having a top flange portion adapted to be secured to the floor and a sleeve portion adapted to extend through an opening in the floor for connection with the drain pipe, said top flange portion having bolt head insert openings adapted to be aligned with the bolt holes when the bowl is secured to the floor, fastening bolts extending upwardly from the bolt head openings in the top flange portion, said depending sleeve portion having an internal tapered seat, a sealing ring nested in the floor flange and having external and internal tapered seats with its external tapered seat in sealing engagement with the flange sleeve portion tapered eat, a centering funnel secured to the undersurface of the toilet bowl about its discharge opening and having an external tapered seat in removeable sealing engagement with the internal tapered seat of the sealing ring, and said fastening bolts being releaseably secured with the holes of the toilet bowl base whereby to provide multiple tapered seals between all of the nested parts of the assembly while permitting disengagement of the toilet bowl with its centering funnel from the assembly for inspection of the sealing ring.

* * * * *